US007703615B2

(12) United States Patent
Willim

(10) Patent No.: US 7,703,615 B2
(45) Date of Patent: Apr. 27, 2010

(54) LATTICE PIECE FOR A LARGE MOBILE CRANE AND METHOD OF ERECTING THE SAME

(75) Inventor: Hans-Dieter Willim, Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 12/004,208

(22) Filed: Dec. 20, 2007

(65) Prior Publication Data

US 2008/0173605 A1 Jul. 24, 2008

(30) Foreign Application Priority Data

Dec. 20, 2006 (DE) ..... 10 2006 060 347

(51) Int. Cl.
*B66C 23/70* (2006.01)

(52) U.S. Cl. ..... 212/175; 52/646; 212/177; 212/270

(58) Field of Classification Search ..... 212/175–177, 212/270; 52/645, 646
See application file for complete search history.

(56) References Cited

U.S. PATENT DOCUMENTS

| | | | | |
|---|---|---|---|---|
| 2,987,148 | A * | 6/1961 | Millard | 52/111 |
| 3,564,789 | A * | 2/1971 | Vyvyan et al. | 52/108 |
| 3,593,481 | A * | 7/1971 | Mikulin | 52/632 |
| 3,751,863 | A * | 8/1973 | Lyons | 52/111 |
| 3,866,760 | A * | 2/1975 | Reich | 212/176 |
| 4,016,974 | A * | 4/1977 | Tax | 206/321 |
| 4,604,844 | A * | 8/1986 | Mikulas et al. | 52/632 |
| 5,016,418 | A * | 5/1991 | Rhodes et al. | 52/646 |
| 5,040,349 | A * | 8/1991 | Onoda et al. | 52/646 |
| 5,125,206 | A * | 6/1992 | Motohashi et al. | 52/646 |
| 5,163,262 | A * | 11/1992 | Adams | 52/646 |
| 6,161,359 | A * | 12/2000 | Ono | 52/651.1 |
| 6,986,230 | B2 * | 1/2006 | Schipani et al. | 52/694 |
| 7,028,442 | B2 * | 4/2006 | Merrifield | 52/651.1 |

FOREIGN PATENT DOCUMENTS

| | | |
|---|---|---|
| CH | 665 826 | 6/1988 |
| DE | 7227376 | 11/1972 |
| DE | 3246217 | 6/1984 |
| DE | 69408880 | 7/1998 |
| DE | 20 2004 015072 | 2/2006 |
| EP | 0376 417 | 7/1990 |
| EP | 0609 998 | 8/1994 |
| EP | 1015 374 | 7/2000 |
| WO | 98/54080 | 12/1998 |

* cited by examiner

*Primary Examiner*—Thomas J. Brahan
(74) *Attorney, Agent, or Firm*—Dilworth & Barrese LLP

(57) ABSTRACT

This invention relates to a lattice piece for a large mobile crane, comprising four corner posts and null bars and diagonal bars connecting the same. In accordance with the invention, the lattice piece each is divided in two such that one part of the null and diagonal bars each is foldably hinged at two corner posts connected with each other. Furthermore, the invention relates to a method for erecting such lattice piece.

21 Claims, 7 Drawing Sheets

LATTICE PIECE FOR A LARGE MOBILE CRANE AND METHOD OF ERECTING THE SAME

BACKGROUND OF THE INVENTION

This invention relates to a lattice piece for a large mobile crane and a method of erecting such lattice piece.

Large mobile cranes are transported to the respective sites of operation on public roads. Here, the rules of public road traffic are applicable, in Germany for instance the German Road Traffic Regulations. The maximum admissible weights and also dimensions are specified, for instance. In other countries, similar regulations are applicable.

These regulations lead to the fact that the dimensions of the parts to be transported are limited. As a result, the total size of the mobile crane and therefore also the maximum achievable load capacity and the outreach (load moment) thereof also are limited.

Different approaches for increasing the load capacity have already been formulated. In DE 20 2005 017 362 U1, for instance, it has already been proposed to couple two cranes. From WO 2005/030632 A1 it is known to use two booms on one crane in parallel. In these two proposals, the two booms provided here are connected with each other.

In accordance with another proposal, lateral reinforcements were mounted on both sides of the booms and adjusted by means of a dual derrick (as proposed in DE 100 02 917 A1).

In EP 1 015 374 B1 it is described already to create lattice pieces which are dimensioned slightly smaller than the dimensions of a container, in order to simplify the transport of the lattice pieces. Here, differently profiled corner posts were used. The transport of the lattice pieces was effected analogous to the transport of a container with corresponding connections, as they are known for containers.

Since the booms constructed of the lattice pieces should be slewable on a common axis, all solutions have in common that the width of the assembled booms always was larger than the height. Thus, the known booms have less load capacity in the luffing plane than vertical to the luffing plane. In the case of long and heavy main booms, the maximum length to be erected also is limited by the cross-sectional values of the boom in the luffing plane.

With large radii, the "buckling bar boom" also is greatly loaded by its own weight in the direction of the luffing plane, i.e. high cross-sectional values of the boom provide for high load capacity values.

SUMMARY OF THE INVENTION

It is the object of the present invention to create lattice pieces which can be used in a large mobile crane, wherein extremely high loads can be lifted to large altitudes, with the individual lattice pieces nevertheless remaining suitable for road transport.

In accordance with the invention, this object is solved by a lattice piece with the features described herein.

Accordingly, a lattice piece for a large mobile crane, which consists of four corner posts and of diagonal bars connecting the same, is divided in two such that one part of the diagonal bars each is foldably hinged at two corner posts connected with each other. The lattice pieces of the invention can be transported in this disassembled form. In this way, large lattice pieces can be created with a profile which has a cross-section of e.g. 8×6 m and a length of 11 m. The lattice pieces of the present invention can be assembled to form a correspondingly powerful boom. The lattice pieces of the invention can be transported with so-called flat containers. The same have dimensions which are uniform all over the world.

While the length of the lattice pieces can be chosen such that the length can be maintained during transport, disassembly of the lattice pieces in two parts preferably is chosen such that disassembly is effected both in the width and in the height of the lattice pieces. The lattice pieces should be designed such that assembly and disassembly of the respective lattice piece can be performed economically. This means that assembly and disassembly of the lattice piece must be effected within a reasonable period, with as little auxiliary devices as possible and in consideration of safety during assembly and disassembly.

Advantageous aspects of the invention can be taken from the description herein.

Accordingly, null bars additionally can be foldably hinged at two corner posts connected with each other. These null bars serve to increase stability. They are, however, not absolutely necessary. In accordance with another preferred aspect of the invention, a rigid connection can instead be used between the individual lattice pieces.

Furthermore, the lattice pieces advantageously can have corner posts made of profiles which have fork-finger connections at their ends. At each corner post, four null bars and four diagonal bars can be hinged.

At least part of the null bars and/or of the diagonal bars can be telescopable.

During assembly, both the null bars and the diagonal bars can each be fixable at the corner posts or at each other via bolt connections.

Advantageously, the profile of the corner posts is fabricated of two angular sheets welded to each other in the form of a box, to each of which the fork-finger connections are welded. Advantageously, the connection between the corner posts and the diagonal and null bars is rigid.

Advantageously, positioning devices can be provided for positioning the diagonal bars and/or null bars in the disassembled condition. Thus, the transport units are safely kept connected. In the assembled lattice piece and in crane operation, the positioning devices also can remain on or in the lattice piece.

A further advantageous aspect of the invention consists in that in each lattice element an additional spatial diagonal is provided.

A preferred method for erecting a lattice piece of the invention consists of the following steps:

- placing the two lattice piece parts beside each other;
- swivelling out corresponding diagonal bars and bolting with the corner posts of the opposed lattice piece parts,
- lifting the upper disk obtained by connecting the lattice piece parts and thereby extending four telescopable diagonal bars and bolting the diagonal bars in their extended position;
- bolting the null bars swivelled into the end position while lifting.

Particularly advantageously, the null bars can roll along the corner posts via rollers disposed on their free ends during erection.

BRIEF DESCRIPTION OF THE DRAWINGS

Further features, details and advantages of the invention can be taken from the embodiments illustrated in the drawing, in which.

DESCRIPTION OF THE PREFERRED EMBODIMENTS

Figure 1:
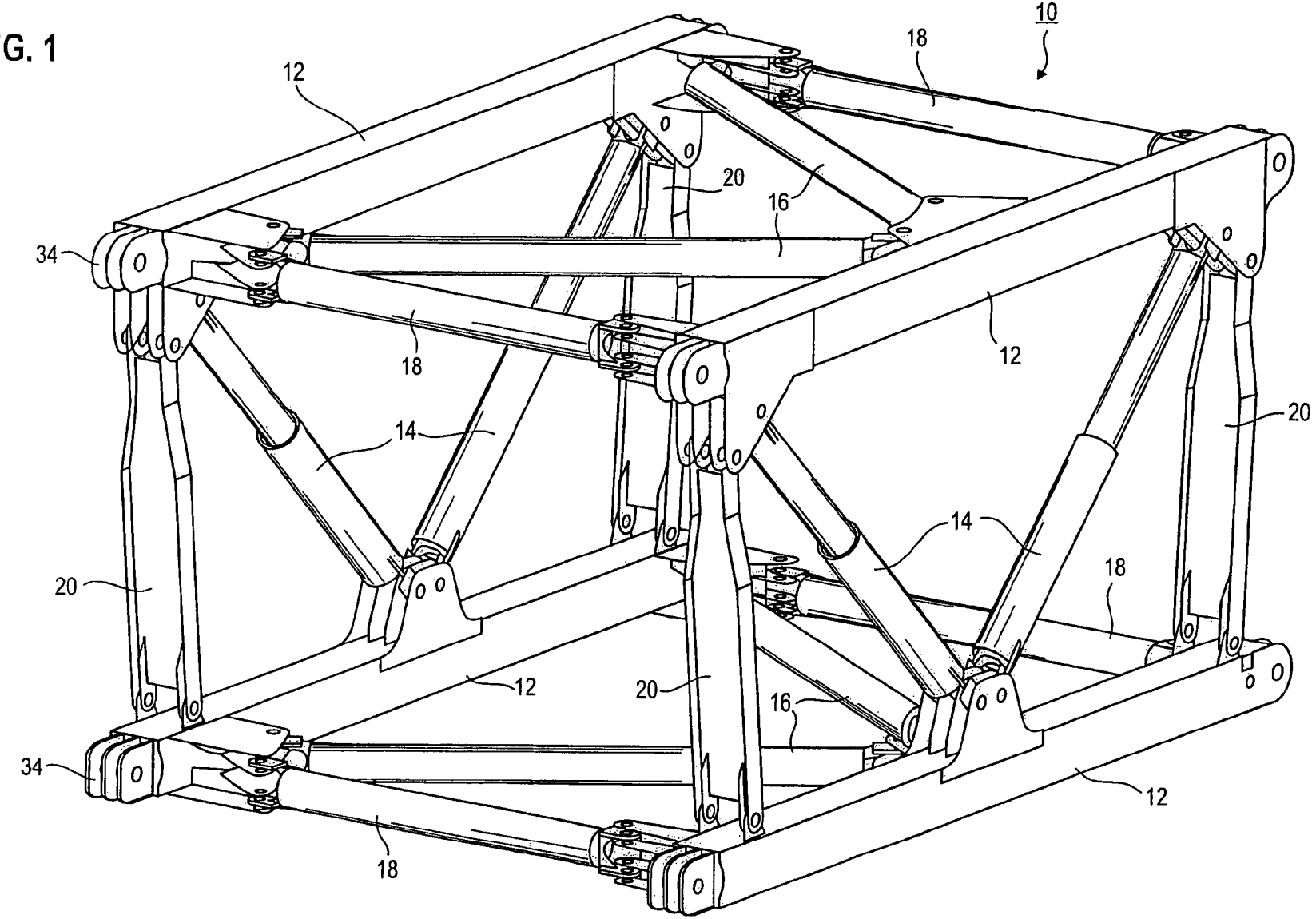
FIG. 1: shows a perspective view of a lattice piece of the invention in the assembled form.

In FIG. 1, a lattice piece 10 of the invention is shown in perspective. This lattice piece consists of four corner posts 12, which are connected with each other via diagonal bars 14 and 16 and null bars 18 and 20, respectively. A lattice piece 10, as shown in FIGS. 1 to 5, for instance has a length L of 11 m, a width B of 8 m and a height H of 6 m.

Figure 2:
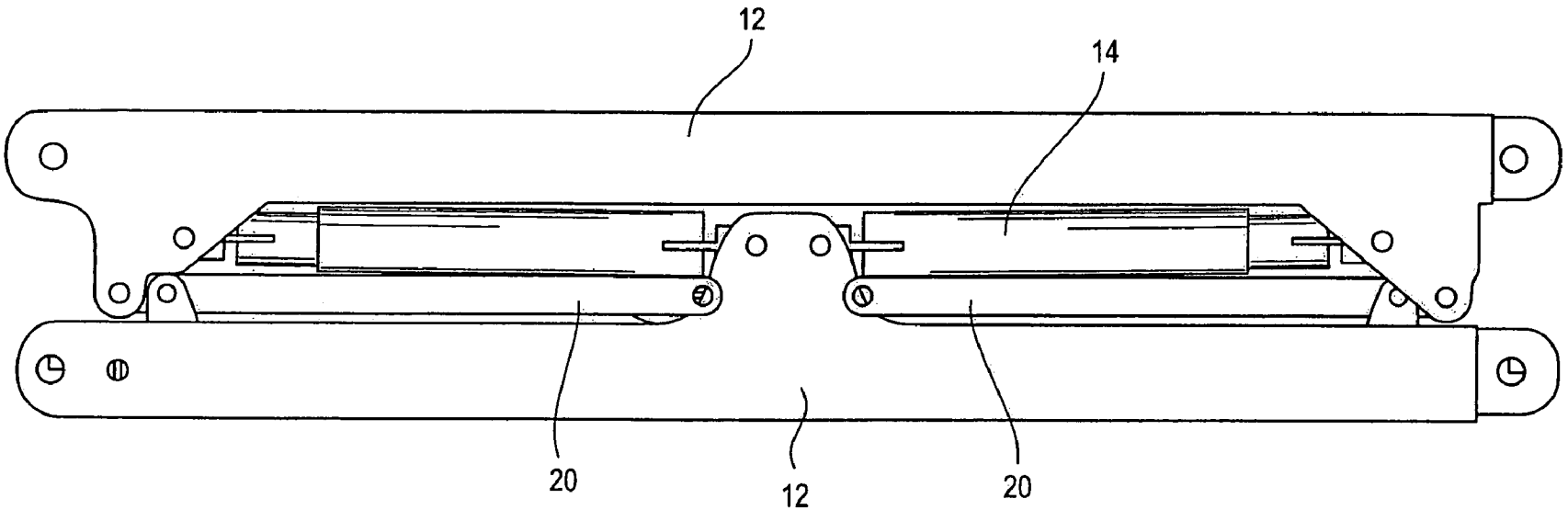
FIG. 2: shows a side view of a lattice piece of FIG. 1 in the folded form.
Figure 3:
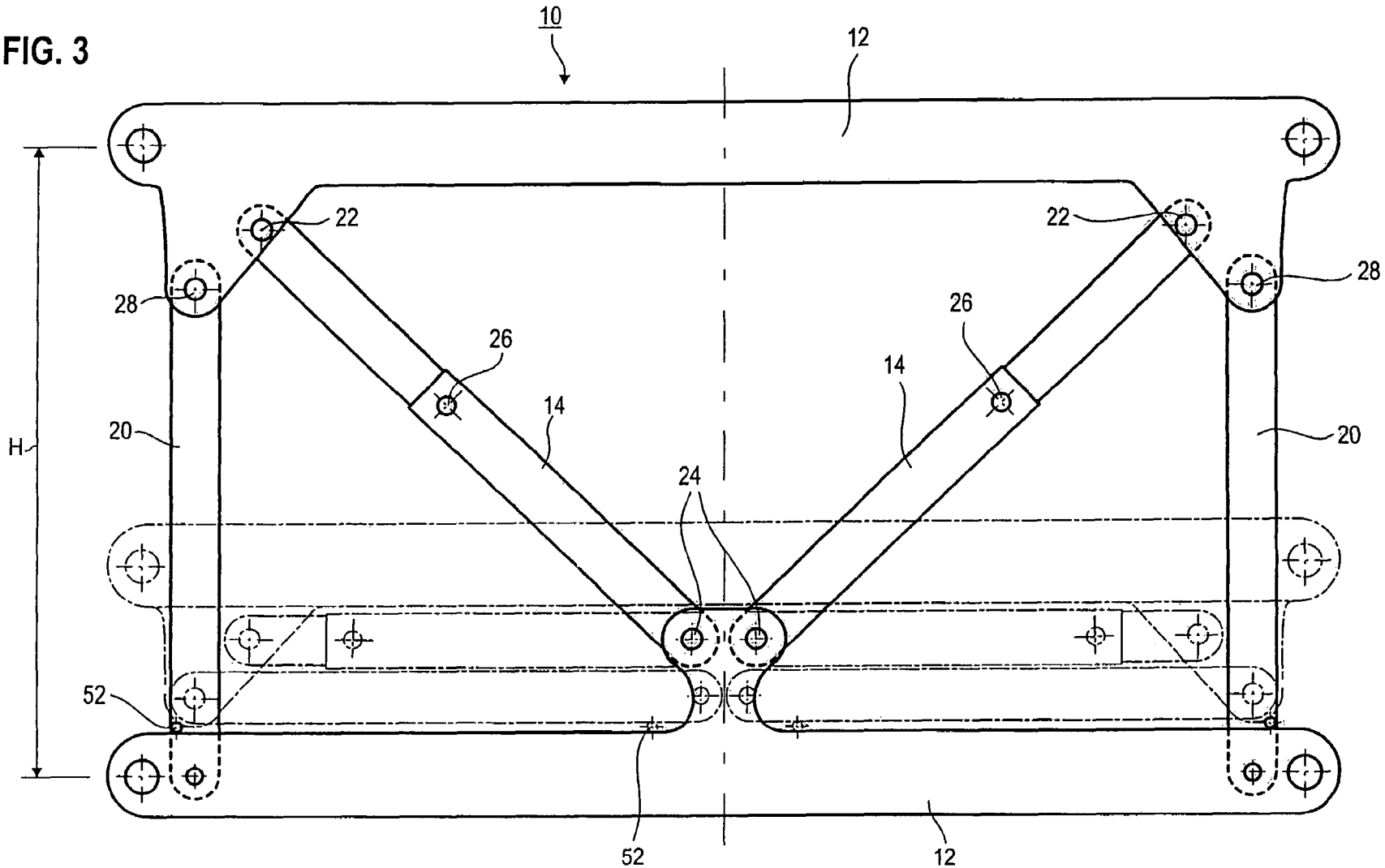
FIG. 3: shows a side view of a lattice piece of FIG. 1, FIG. 4: shows a top view of a lattice piece of FIG. 1, FIG. 5: shows a front view of a lattice piece of FIG. 1, FIG. 6: shows a partial section through a part of a lattice piece, and FIGS. 7*a*)-*c*): show a schematic representation of the process of erection of a lattice piece of the invention in various intermediate stages.

To be able to transport this lattice piece on the road, it is divided in two. There are formed two lattice piece halves, which each comprise two corner posts 12. Proceeding from the assembled lattice piece as shown in FIG. 1, these lattice piece parts are formed in that corresponding bolt connections on the diagonal bars 16 and on the null bars 18 are released on at least one side each. The respectively divided lattice pieces 10 then are transferred into a folded position, as shown in FIG. 2. For this purpose, the null bars 20 are folded in and the diagonal bars 14, which are telescopable, are telescoped in. The correspondingly folded or extended condition is shown in FIG. 3 by the distinction between continuous lines and dash-dotted lines. As shown in FIG. 3, the diagonal bars 14 each are hinged at swivel points 22 and 24 of the corner posts 12. In the extended position, as shown in FIG. 3 in a continuous line, the diagonal bars 14 are bolted in their extended position via bolts 26. The null bars 20 each are hinged at a corner post 12 via swivel points 28. The opposite free end can be bolted with the opposite corner post 12.

Figure 4:
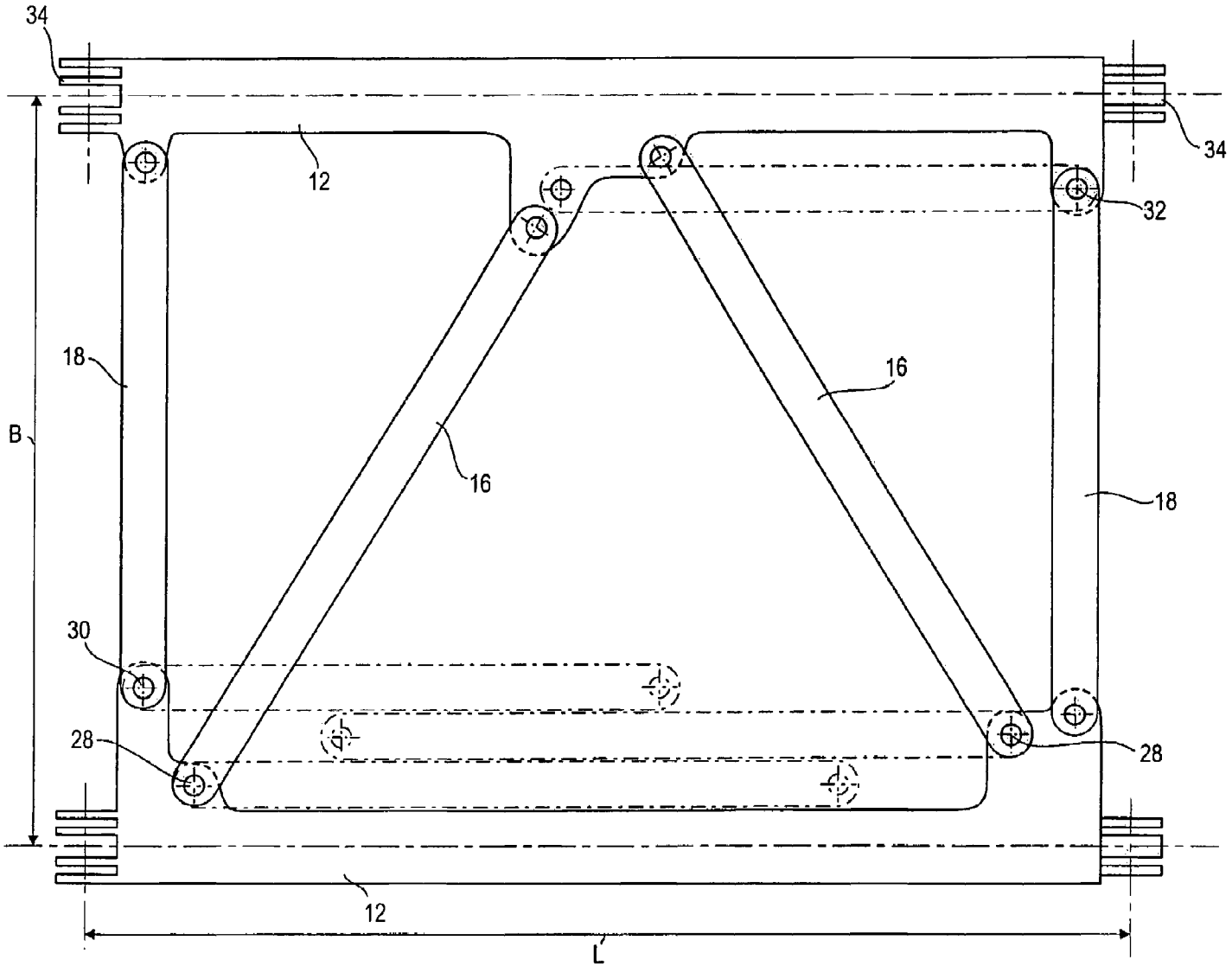
Figure 5:
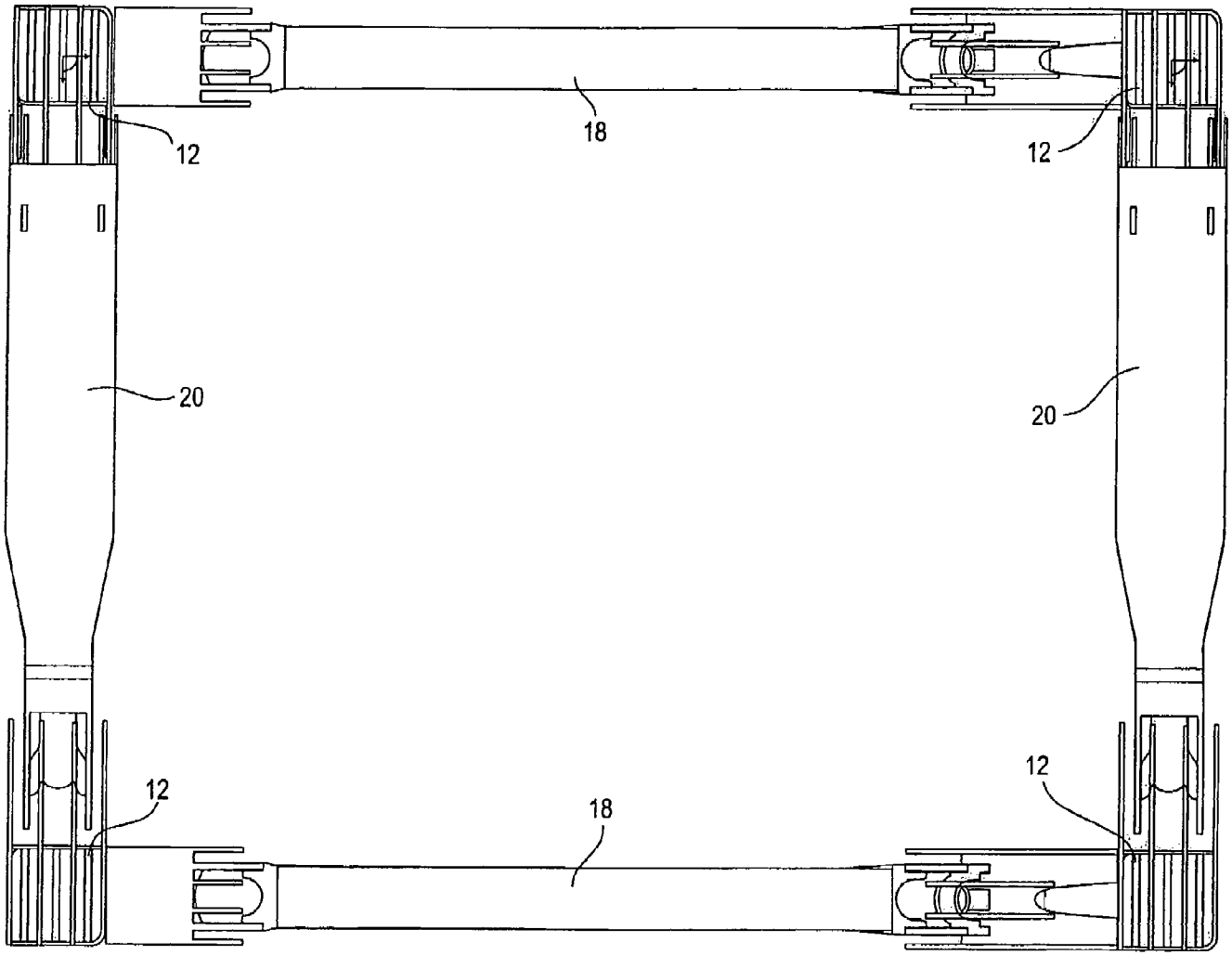

In FIG. 4, a top view is shown. Here, the corner posts 12 are connected with each other via the diagonal bars 16 and the null bars 18. The diagonal bars 16 can be swivelled about swivel points 28, whereas the null bars 18 can be swivelled about swivel points 30 and 32, respectively. The position swivelled in each is represented in FIG. 4 by dash-dotted lines. In the illustrated extended position, the free ends of the diagonal bars 16 and null bars 18, respectively, each are bolted with the opposite bolting point on the corner post 12. As shown in FIG. 5, no spatial diagonal bars are provided. Only the adjacent corner posts 12 each are connected with each other. This is enabled by creating rigid connections between the corner posts 12 and the diagonals 16 and 14, respectively, and the null bars 18 and 20, respectively.

Between the lattice pieces, very high forces must be transmitted. Thus, the fork-finger connections 34 provided on the corner pieces 12 are subjected to very high loads. To facilitate the handling of the bolts, multishear fork-finger connections 34 can be used, as shown for instance in FIG. 4 or FIG. 1. Here, comparatively smaller bolts can be used.

Figure 6:
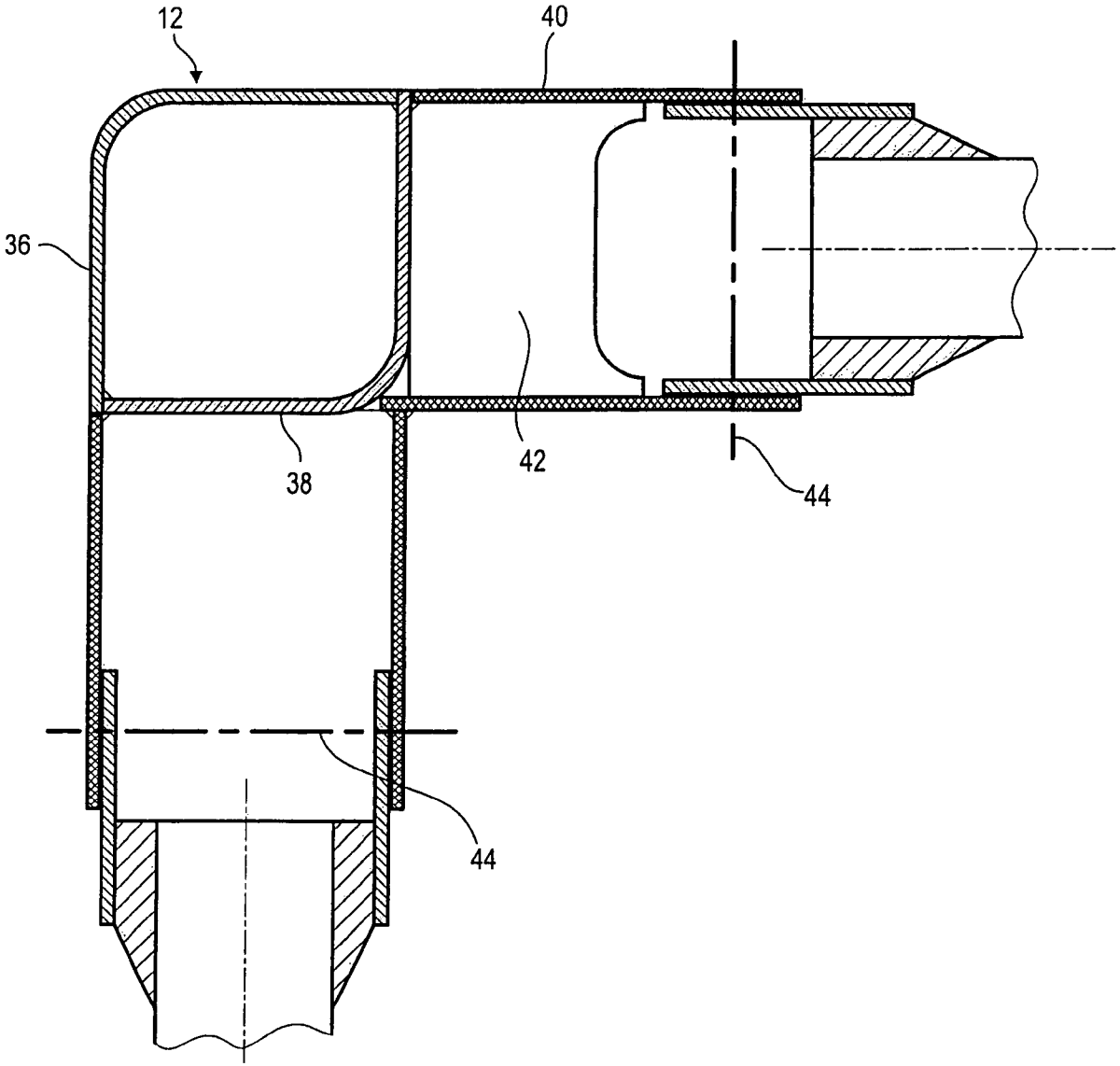

The corner posts 12 can be fabricated of any kind of profile. Advantageously, the profile is made of two angular and welded sheets 36, 38, in accordance with the embodiments as shown in FIG. 6. The profile of square cross-section has a side length of about 800×800 mm. To the corner piece, guide sheets 40 with corresponding reinforcements 42 can be welded for receiving the null bars or diagonal bars. Bolt connections here are designated with reference numeral 44.

The profiles of the diagonal bars 14, 16 and of the null bars 18, 20 can be as desired. For instance, they consist of a welded pipe construction or a welded construction of straight or bent sheets. In any case, however, the profiles are protected against buckling.

Figure 7:
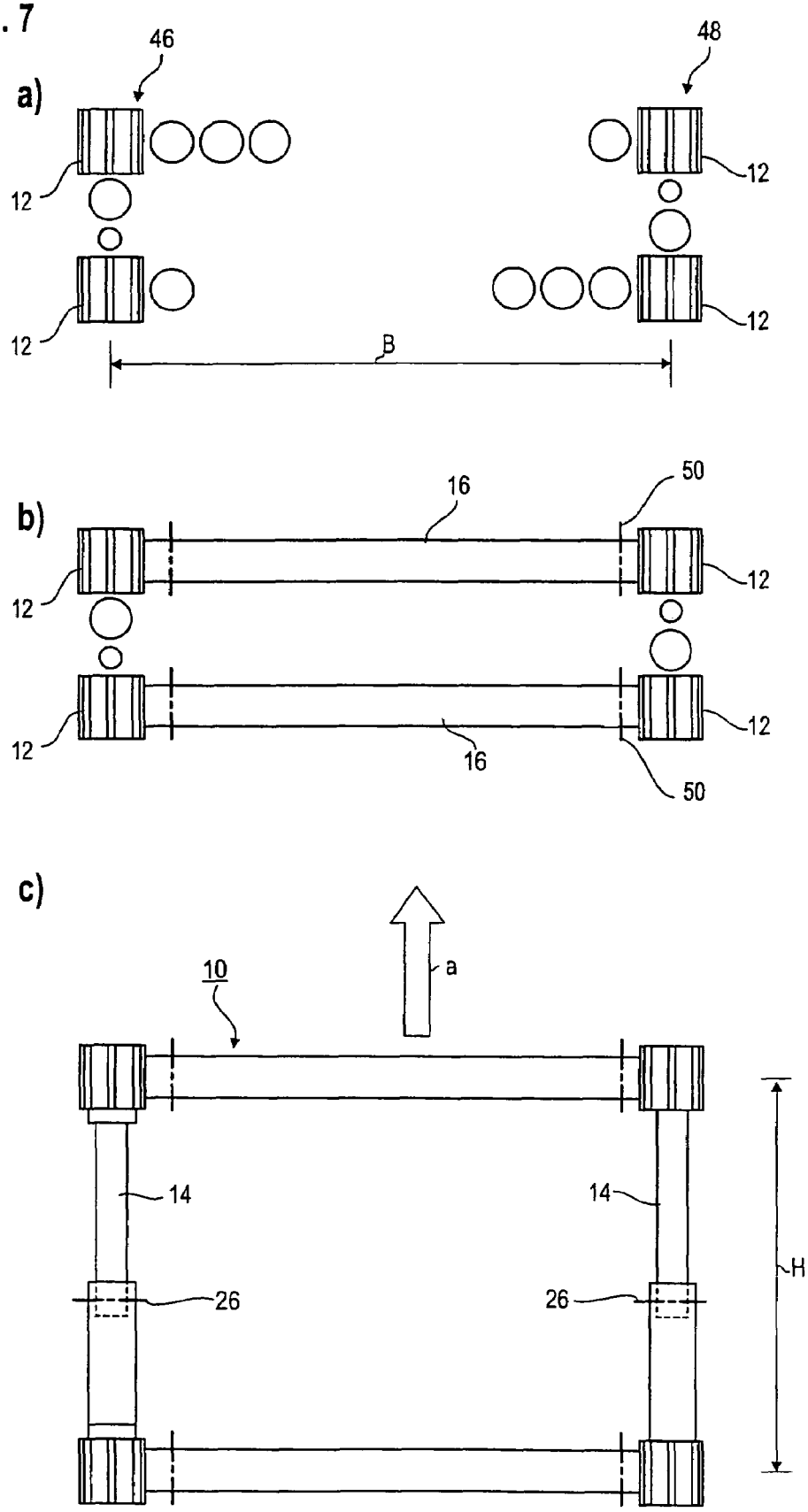

With reference to FIG. 7, the procedure for assembly of the lattice piece of the invention is shown schematically and by way of example.

FIG. 7*a* shows how a first transport unit 46 is removed by means of a non-illustrated auxiliary crane from a likewise non-illustrated flat container, on which the first transport unit was transported, and is put down by a second transport unit 48 at a distance B. This second transport unit 48 previously likewise was picked up from a flat container by means of the auxiliary crane and put down at the position shown in FIG. 7*a*.

As shown in FIG. 7*b*, the lower diagonal bars 16 first were swivelled out and bolted, whereby the distance B of 8 m is obtained. For correspondingly unfolding, the diagonal bars 16 and the null bars 18 are suspended on an auxiliary crane. After the lower diagonals 16 and the lower null bars 18 were swivelled out and bolted, the upper diagonals 16 and the upper null bars 18, i.e. the diagonals 16 and the null bars 18 of the upper disk, are swivelled out and bolted with the corner posts 12 by means of bolts 50.

As shown in FIG. 7*c*, the upper disk then is lifted to the top in the direction of arrow a by means of a non-illustrated auxiliary crane. As a result, the four telescopable diagonal bars 14, which are shown in FIG. 7*c* not in a side view, but in a front view, are extended, so that the height of 6 m is obtained. In the corresponding end position, the diagonal bars are bolted with each other via bolts 26. While erecting the lattice piece 10 by means of the auxiliary crane, the null bars 20, which for simplification are not shown in FIG. 7*c*, run over rollers 52 (cf. FIG. 3) along the corner posts 12 into their assembly position. As shown in the slightly modified embodiment of FIG. 3, the null bars 20 can enclose the corner posts 12 in a fork-like manner. In this position, the null bars 20 can be bolted with the corner posts 12. In accordance with the embodiment of FIG. 1 and FIG. 5, the null bars 20 are bolted with corresponding tabs welded to the corner posts. What is not shown here are rollers, which act similar to the way described in FIG. 3.

For again folding the boom 10 now from its erected position, as it is shown for instance in FIG. 3, the null bars 20 are slightly pressed to the inside after removing the bolts, until a lever arm is obtained on the roller 52, so that when lowering the upper disk, the null bar 20 runs further along the corner post 12 under its own weight. During disassembly, the bolts 26 of course are withdrawn, so that the telescopable diagonal bars 24 can be pushed together.

Similar to the lattice pieces 10 shown here, the hinged piece or the head piece (not shown here) can be designed to be foldable.

The invention claimed is:

1. A lattice piece (10) for a large mobile crane and structured and arranged to be separated and foldable, comprising four corner posts (12), diagonal bars (14, 16) structured and arranged for connecting each corner post (12) with two adjacent corner posts (12) and each being foldably hinged at two corner posts (12) connected with each other, and null bars (18, 20) foldably hinged at two corner posts (12) connected with each other, wherein the lattice piece (10) is separable and foldable into two distinct parts (46, 48) such that in separated and folded condition, each said distinct part (46, 48) contains two corner posts (12) one on top of the other, with the diagonal bars (14, 16) and null bars (18, 20) each being pivotally coupled to one of said corner posts (12) in each said distinct part (46, 48) and said two distinct parts (46, 48) being configured to be totally disassembled and separated from one another in said folded condition to facilitate transport from the crane operating site.

2. A plurality of lattice pieces according to claim 1, additionally comprising rigid connections between adjacent lattice pieces.

3. The lattice pieces according to claim 2, wherein the corner posts (12) are made of profiles which have fork-finger connections (34) at their ends.

4. The lattice pieces according to claim 3, wherein four null bars (18, 20) and four diagonal bars (14, 16) are hinged at each corner post (12).

5. The lattice piece according to claim 1, wherein the corner posts (12) are made of profiles which have fork-finger connections (34) at their ends.

6. The lattice piece according to claim 5, wherein four null bars (18, 20) and four diagonal bars (14, 16) are hinged at each corner post (12).

7. The lattice piece according to claim 1, wherein four null bars (18, 20) and four diagonal bars (14, 16) are hinged at each corner post (12).

8. The lattice piece according to claim 1, wherein the diagonal bars (14, 16) and/or the null bars (18, 20) are at least partly telescopable to retract upon retraction or folding of the piece.

9. The lattice piece according to claim 1, wherein the null bars (18, 20) and/or diagonal bars (14, 16) each can be fixed at the corner posts (12) or at each other via bolt connections.

10. The lattice piece according to claim 1, wherein the profile of the corner posts (12) is made of two angular sheets welded to each other in the form of a box.

11. The lattice piece according to claim 1, configured to be disassembled into size and dimensions for transport in or on a container.

12. The lattice piece according to claim 1, wherein the connections between the corner posts (12) and the diagonal bars (14, 16) and null bars (18, 20) are at least partly rigid.

13. The lattice piece according to claim 1, wherein additionally a spatial diagonal bar is provided.

14. The lattice piece according to claim 1, wherein positioning devices are provided for positioning the diagonal bars (14, 16) and/or null bars (18, 20) in the disassembled condition.

15. The lattice piece according to claim 1, wherein the diagonal bars (14, 16) are each foldably hinged at opposite ends to two corner posts (12).

16. The lattice piece according to claim 1, comprising a total of eight diagonal bars (14, 16), with each said diagonal bar (14, 16) pivotally hinged at one end to a corner post (12) at a swivel point (24) near a center of the respective corner post (12) and, at an opposite end to a corner post (12) at a swivel point (22) positioned at or near an end of the respective corner post (12).

17. The lattice piece according to claim 16, additionally comprising a total of eight null bars (18, 20) each being pivotally hinged at opposite ends to respective corner posts (12) at or near ends of the respective corner posts (12).

18. The lattice piece according to claim 17, wherein four (14) of said diagonal bars (14, 16) are telescopable to retract upon retraction or folding of the piece.

19. The lattice piece according to claim 18, configured to be disassembled to size and dimensions for transport in or on a flat container.

20. A method for erecting a lattice piece (10), comprising the following steps:

placing two lattice piece parts (46, 48) beside each other, each said lattice piece part (46, 48) comprising two corner posts (12) one on top of the other, with diagonal bars (14, 16) and null bars (18, 20) pivotally coupled to one of said corner posts (12);

swivelling out corresponding diagonal bars (14, 16) and null bars (18, 20) and bolting with the corner posts (20) of the opposed lattice piece parts (46, 48);

lifting an upper section obtained by connecting the lattice piece parts and thereby extending telescopable diagonal bars (18, 20) and bolting the diagonal bars (18, 20) in their extended position; and bolting the null bars (14, 16) swivelled into the end position while lifting.

21. The method according to claim 20, wherein during erection the null bars (14, 16) roll along the corner posts via rollers (52) disposed at their free ends.

* * * * *